US010193291B2

(12) United States Patent
Houser et al.

(10) Patent No.: US 10,193,291 B2
(45) Date of Patent: Jan. 29, 2019

(54) ROTARY CRIMPING TOOL ASSEMBLY

(71) Applicant: Tyco Electronics Corporation, Berwyn, PA (US)

(72) Inventors: Matthew Steven Houser, Hummelstown, PA (US); Robert Neil Mulfinger, York Haven, PA (US); John Louis McKibben, Dallastown, PA (US); Kevin Michael Thackston, York, PA (US); Lynn Robert Sipe, Mifflintown, PA (US); Marissa Jayne Feinman, Harrisburg, PA (US); David James Fabian, Mount Joy, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 296 days.

(21) Appl. No.: 14/602,385

(22) Filed: Jan. 22, 2015

(65) Prior Publication Data

US 2016/0104993 A1 Apr. 14, 2016

Related U.S. Application Data

(60) Provisional application No. 62/062,979, filed on Oct. 13, 2014.

(51) Int. Cl.
*H01R 43/048* (2006.01)
*B21B 17/00* (2006.01)
(Continued)

(52) U.S. Cl.
CPC ..... *H01R 43/048* (2013.01); *B21B 17/00* (2013.01); *B21B 19/00* (2013.01); *B21B 19/12* (2013.01); *B21B 19/14* (2013.01); *B21D 35/005* (2013.01); *B21D 35/006* (2013.01); *H01R 43/0424* (2013.01); *H01R 43/0484* (2013.01);
(Continued)

(58) Field of Classification Search
CPC ..... H01R 43/048; H01R 43/0424; H01R 43/0484; B21B 17/00; B21B 21/02; B21B 31/02; B21B 19/00; B21B 19/12; B21B 19/14; B21H 1/18; B21H 1/20; B21D 35/005; B21D 35/006; B21D 17/02; B21D 17/04; B21D 39/04; B21D 39/044; B21D 39/046; B21D 39/048; B21K 1/74;
(Continued)

(56) References Cited

U.S. PATENT DOCUMENTS 1,767,896 A * 6/1930 Roeckner ..... B21B 19/14 72/105
3,955,044 A 5/1976 Hoffman et al.
(Continued)

FOREIGN PATENT DOCUMENTS

FR 2 620 579 3/1989
FR 2 920 599 3/2009
(Continued)

*Primary Examiner* — A. Dexter Tugbang

(57) ABSTRACT

A rotary crimping tool assembly includes a tool housing defining a crimping chamber, and one or more crimp wheels within the crimping chamber. The crimping chamber is configured to receive the portion of the structure in proximity to the crimp wheel(s). The crimp wheel(s) are configured to be pressed into and rotated relative to the portion of the structure to form one or more crimps in the portion of the structure.

17 Claims, 9 Drawing Sheets

(51) Int. Cl.

| | |
|---|---|
| ***B21B 19/00*** | (2006.01) |
| ***B21B 19/14*** | (2006.01) |
| ***B21B 19/12*** | (2006.01) |
| ***B21D 35/00*** | (2006.01) |
| ***H01R 43/042*** | (2006.01) |
| *B21B 21/02* | (2006.01) |
| *B21H 1/20* | (2006.01) |
| *B21B 31/02* | (2006.01) |
| *B21H 1/18* | (2006.01) |
| *B21D 39/04* | (2006.01) |
| *B21K 1/74* | (2006.01) |

(52) U.S. Cl.
CPC ..... *B21B 21/02* (2013.01); *B21B 31/02* (2013.01); *B21D 39/04* (2013.01); *B21D 39/044* (2013.01); *B21D 39/046* (2013.01); *B21D 39/048* (2013.01); *B21H 1/18* (2013.01); *B21H 1/20* (2013.01); *B21K 1/74* (2013.01); *Y10T 29/49181* (2015.01); *Y10T 29/49218* (2015.01); *Y10T 29/53235* (2015.01)

(58) Field of Classification Search
CPC ..... Y10T 29/49181; Y10T 29/49218; Y10T 29/53235
See application file for complete search history.

(56) References Cited

U.S. PATENT DOCUMENTS

| | | | | |
|---|---|---|---|---|
| 4,936,131 | A * | 6/1990 | Gray | B21K 1/74 470/110 |
| 5,393,932 | A | 2/1995 | Young et al. | |
| 5,481,893 | A * | 1/1996 | Barjasteh | B21D 39/046 72/107 |
| 6,196,039 | B1 * | 3/2001 | Williams | B21D 17/04 72/105 |
| 2009/0205390 | A1 * | 8/2009 | Hermann | B21D 35/006 72/252.5 |
| 2010/0200261 | A1 | 8/2010 | Boutot | |
| 2011/0113847 | A1 * | 5/2011 | Norikura | B21B 31/02 72/226 |
| 2012/0085137 | A1 * | 4/2012 | Boguslaysky | B21H 1/18 72/213 |

FOREIGN PATENT DOCUMENTS

| | | | |
|---|---|---|---|
| GB | 755 272 | A | 8/1956 |
| JP | 2008272824 | A * | 11/2008 |
| JP | 2014 164847 | A | 9/2014 |

* cited by examiner

ROTARY CRIMPING TOOL ASSEMBLY

RELATED APPLICATIONS

This application relates to and claims priority benefits from U.S. Provisional Patent Application No. 62/062,979 entitled "Rotary Crimping Tool Assembly," filed Oct. 13, 2014, which is hereby incorporated by reference in its entirety.

BACKGROUND OF THE DISCLOSURE

Embodiments of the present disclosure generally relate to systems and methods for crimping a structure, such as a conductive wire assembly.

Conductive wire assemblies are used to provide power and/or data signals between various components. A typical conductive wire assembly includes an insulating cover that surrounds portions of a conductive wire. A distal end of the insulating cover may be stripped in order to expose a portion of the conductive wire so that the exposed portion of the conductive wire may contact conductive portions of a contact terminal, for example.

In order to electrically and mechanically connect a conductive wire assembly to a contact terminal, portions of the conductive wire assembly and the contact terminal may be crimped together. One known method crimps an outer housing of the contact terminal with the conductive wire of the conductive wire assembly in order to provide a conductive electrical connection therebetween. Additionally, a separate seal is crimped around the insulating cover in order to provide a fluid tight seal (for example, a seal that is air and gas tight) that prevents water or moisture from infiltrating into the conductive interface between the conductive wire and the contact terminal. As such, the process of connecting the conductive wire assembly to the contact terminal includes two separate and distinct crimping operations.

Another known method crimps a conductive wire to a housing of a contact terminal and then heat shrinks a separate seal around the insulating wire. This method also provides two separate and distinct steps, namely, a crimping operation and a heat-shrinking operation.

In general, in order to crimp a contact terminal to a conductive wire assembly, a high degree of force is used to compress components together. Typically, large stationary tools are used to compress components together, such as through crimping.

As can be appreciated, known methods of connecting a conductive wire to a contact terminal may be time and labor intensive. For example, in using multiple forming operations, such as multiple crimping and/or crimping and heat-shrinking operations, time and cost is added to the manufacturing process. Accordingly, a need exists for a simpler and more efficient system and method for connecting a conductive wire assembly to a contact terminal.

BRIEF DESCRIPTION OF THE DISCLOSURE

Certain embodiments of the present disclosure provide a rotary crimping tool assembly configured to crimp a portion of a structure. The rotary crimping tool assembly may include a tool housing defining a crimping chamber, and one or more crimp wheels within the crimping chamber. The crimping chamber is configured to receive the portion of the structure in proximity to the one or more crimp wheels. The crimp wheel(s) is configured to be pressed into and rotated relative to the portion of the structure to form one or more crimps in the portion of the structure.

In at least one embodiment, the tool housing may include a first frame secured to a second frame. The rotary crimping tool assembly may include an adjustable mount adjustably secured to one or both of the first and second frames, and one or more rollers rotatably secured to the adjustable mount. The crimp wheel(s) may be secured to one of the first and second frames. The crimping chamber may be configured to receive the portion of the structure between the crimp wheel(s) and the roller(s). The adjustable mount may be configured to be adjusted to compress the portion of the structure between the crimp wheel(s) and the roller(s). The crimp wheel(s) and the roller(s) may be configured to be rotated about the portion of the structure to form the crimp(s).

In at least one embodiment, first and second rollers are rotatably secured to first and second roller axles that are secured to the adjustable mount. A first crimp wheel is rotatably secured to a crimp axle that is rotatably secured to one of the first and second frames. The crimp axle resides within a central plane, and the first and second roller axles reside within respective first and second roller planes, which are parallel with and offset from the central plane.

The rotary crimping tool assembly may include an adjustment member operatively connected to the adjustable mount. The adjustment member is configured to adjust the adjustable mount in relation to the crimping chamber. In at least one embodiment, the adjustment member includes a threaded shaft connected to a handle. The threaded shaft is threadably secured within a portion of one of the first or second frames. The adjustment member may include a retaining structure extending from a distal end of the threaded shaft. The retaining structure may be secured within a recessed area of the adjustable mount.

Each crimp wheel may include a first crimping surface and a second crimping surface. The first crimping surface may differ from the second crimping surface. In at least one embodiment, each crimp wheel may include a conductor crimp member and a sealing crimp member. The conductor crimp member has a different shape than the sealing crimp member, and is configured to form a first crimp at a first depth into the portion of structure. The sealing crimp member is configured to form a second crimp at a second depth into the portion of structure. The first depth may be deeper than the second depth.

Certain embodiments of the present disclosure provide a method of crimping a structure. The method may include positioning a portion of the structure to be crimped into a crimping chamber of a rotary crimping tool assembly, pressing one or more crimp wheels into the portion of the structure to be crimped, wherein the compressing includes forming one or more initial crimps into the portion of the structure, and rotating the crimp wheel(s) relative to (such as about) the portion of the structure to form one or more full crimps in the portion of the structure.

Certain embodiments of the present disclosure provide a rotary crimping tool assembly configured to crimp a terminal housing of a contact terminal into an insulated wire. A conductive portion of the insulated wire is within the terminal housing. The rotary crimping tool assembly may include a tool housing defining a crimping chamber, an adjustable mount configured to be moved within the crimping chamber, and one or more crimp wheels within the crimping chamber. The crimping chamber is configured to receive the terminal housing in proximity to the crimp wheel(s). The adjustable mount is configured to urge the contact terminal into the crimp wheel(s). The tool housing is configured to be rotated about the terminal housing to form one or more crimps in the terminal housing.

DETAILED DESCRIPTION OF THE DISCLOSURE

Embodiments of the present disclosure provide a rotary crimping tool assembly that may be used to crimp components of a structure, such as conductive wire assembly and/or a contact terminal, grounding jumper, spliced component, and/or the like together. The rotary crimping tool assembly may be used to crimp conductive portions of an insulated wire to a contact terminal, and crimp sealing members of the insulated wire and the contact terminal together. The rotary crimping tool assembly may be sized and shaped to be operated by hand. For example, the rotary crimping tool assembly may be a handheld device that may be easily transported.

Embodiments of the present disclosure provide systems and methods for crimping components of a conductive wire assembly together in a rotary manner. For example, the systems and methods may crimp components together through one or more revolutions. Instead of a cutting wheel, embodiments of the present disclosure provide a rotary crimping tool assembly that may include one or more crimping wheels that are configured to indent a contact terminal housing during a revolution of the tool about an axis. Each crimp wheel may be various sizes and shapes. For example, a portion of the crimp wheel may include a conductor crimp member and a sealing crimp member. The conductor crimp member may have a first height that exceeds a second height of the sealing crimp member. As such, the conductor crimp member may form a deeper crimp, while the sealing crimp member may provide one or more peaks that are shallower than the crimp formed by the conductor crimp member.

Figure 1:
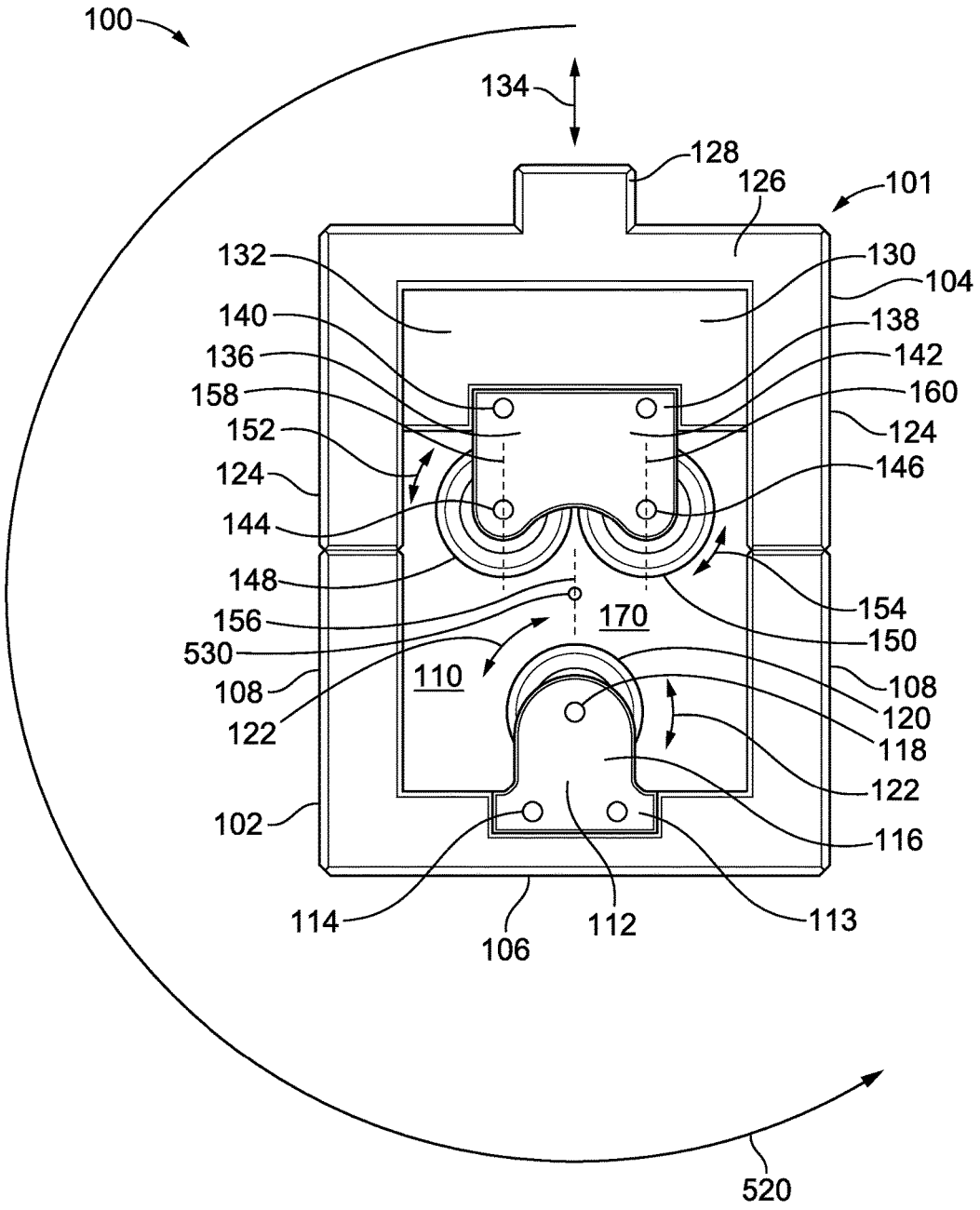
FIG. 1 illustrates a front view of a rotary crimping tool assembly, according to an embodiment of the present disclosure.

FIG. 1 illustrates a front view of a rotary crimping tool assembly 100, according to an embodiment of the present disclosure. The rotary crimping tool assembly 100 may include a tool housing 101 that may include a first or bottom frame 102 connected to a second or upper frame 104. The bottom frame 102 may include a base 106 connected to upstanding lateral walls 108. A crimp wheel chamber 110 is defined between the base 106 and the lateral walls 108. Opposed brackets 112 extend upwardly from the base 106 at opposite ends (for example, the front and rear ends). Each bracket 112 includes a support beam 113 secured to the base 106, such as through one or more fasteners 114, such as screws, bolts, or the like. The support beam 113 connects to an upstanding wheel support 116 that supports an axle 118 that extends between the opposed support beams 113. A crimp wheel 120 is rotatably secured on the axle 118. For example, the crimp wheel 120 is configured to rotate about the axle 118 in the directions of arcs 122.

The upper frame 104 is supported on the bottom frame 102, and includes upstanding lateral walls 124 that are supported on or otherwise by the upstanding lateral walls 108 of the bottom frame 102. The lateral walls 124 connect to a crossbeam 126. An adjuster retainer 128, such as a block, area, or the like having a threaded channel passing therethrough, may extend upwardly from the crossbeam 126.

An adjustable mount 130, such as one or more plate(s), block(s), platform(s), panel(s) or other such structure(s), is movably secured to the upper frame 104 between the lateral walls 124 and the crossbeam 126. The adjustable mount 130 includes a main body 132 that is adjustably positioned between the lateral walls 124 in the directions of arrows 134. Opposed brackets 136 extend downwardly from the main body 132 at opposite ends (for example, the front and rear ends). Each bracket 136 includes a support beam 138 secured to the main body 132, such as through one or more fasteners 140, such as screws, bolts, or the like. The support beam 138 connects to a downwardly-extending wheel support 142 that supports two axles 144 and 146 that extend between the opposed support beams 138. Rollers 148 and 150 are rotatably secured on the axles 144 and 146, respectively. For example, the rollers 148 and 150 are configured to rotate about the respective axles 144 and 146 in the directions of arcs 152 and 154, respectively.

As shown, the axle 118 may be aligned with and in a central plane 156 of the rotary crimping tool assembly 100. The axles 144 and 146 may be aligned with and in respective roller planes 158 and 160, which are parallel to the central plane 156, but may be on opposite sides thereof. As shown, the first and second roller planes 158 and 160 are parallel to, but offset from, the central plane 156.

While the rotary crimping tool assembly 100 is shown having one crimp wheel 120 and two rollers 148 and 150, more or fewer crimp wheels and rollers may be used. For example, the rollers 148 and 150 may also be crimp wheels. Alternatively, the crimp wheel 120 may be a roller, while the rollers 148 and 150 may be crimp wheels. As another alternative, the bottom frame 102 may support two crimp wheels. In at least one other embodiment, the bottom frame 102 may support the crimp wheel 120, and the adjustable mount 130 may support another crimp wheel above the crimp wheel 120.

Figure 2:
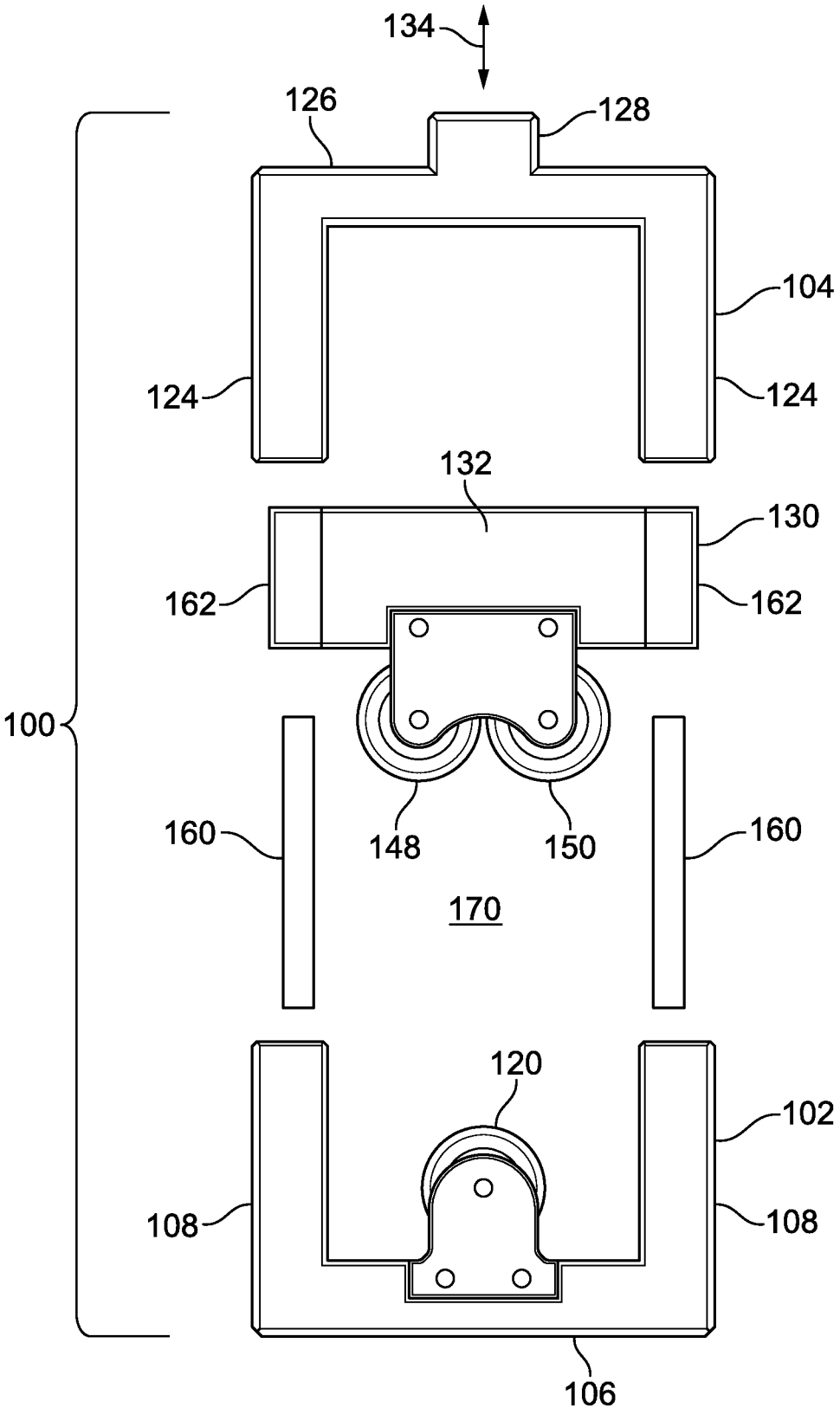
FIG. 2 illustrates a front exploded view of a rotary crimping tool assembly, according to an embodiment of the present disclosure.

FIG. 2 illustrates a front exploded view of the rotary crimping tool assembly 100, according to an embodiment of the present disclosure. Each of the lateral walls 108 and 124 may include internal channels (hidden from view) that are configured to securely retain cylinders 160 and slidably retain lateral supports 162 of the main body 132 of the adjustable mount 130. Each lateral support 162 includes a channel that is configured to slidably conform to an outer surface of a cylinder 160. As such, the adjustable mount 130 is configured to slide in the directions of arrows 134 through a crimping chamber 170 defined between the bottom and upper frames 102 and 104, respectively.

The cylinders 160 may be smooth cylindrical rods that are supported between the bottom and upper frames 102 and 104, respectively. The channels formed through the lateral supports 162 may include axial cross sections that conform to axial cross sections of the cylinders 160.

In order to adjust the height of the adjustable mount 130 within the crimping chamber 170, an adjustment member (not shown in FIG. 2) may be threadably retained within the adjuster retainer 128 and extends into the main body 132 of the adjustable mount 130. The adjustment member, such as a threaded shaft, worm screw, or the like, may be secured to the main body 132, so that rotation of the adjustment member causes the adjustable member 130 to move within the crimping chamber 170 in the directions of arrow 134.

Figure 3:
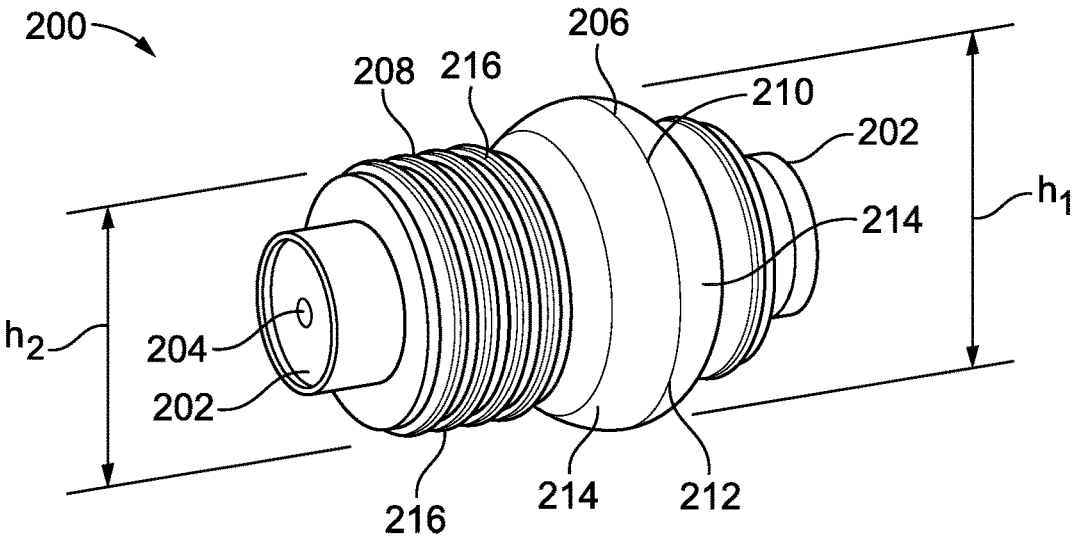
FIG. 3 illustrates a perspective view of a crimp wheel, according to an embodiment of the present disclosure.

FIG. 3 illustrates a perspective view of a crimp wheel 200, according to an embodiment of the present disclosure. The crimp wheel 200 is an example of the crimp wheel 120 shown in FIGS. 1 and 2. The crimp wheel 200 includes end cylinders 202 that have an axle passages 204 formed therethrough. The axle passage 204 receives and retains the axle 118 (shown in FIG. 1) and is configured to allow the crimp wheel 200 to rotate about the axle 118.

The crimp wheel 200 may be configured to form multiple crimps, such as multiple crimp types, patterns, knurls, depths, and/or the like, at various areas of a structure, such as a contact terminal and/or a portion of a conductive wire assembly. For example, the crimp wheel 200 may include a conductor crimp member 206 and a sealing crimp member 208 positioned between the end cylinder 202. The conductor crimp member 206 may include a smooth, arcuate outer surface 210 having a central equator 212 from which lateral portions 214 recede. In this manner, the conductor crimp member 206 may be partially spherical, donut-shaped, or the like. In at least one other embodiment, the conductor crimp member 206 may be fully spherical. The conductor crimp member 206 may have a height $h_1$ that exceeds a height $h_2$ of the sealing crimp member 208. The sealing crimp member 208 may include one or more seal-indenting features 216, such as peaks, ridges, rims, or the like. In operation, the conductor crimp member 206 is configured to be positioned on a terminal housing of a contact terminal (into which a conductive wire is positioned) to form a crimp that secures the contact terminal to the conductive wire, while the sealing crimp member 208 is configured to be positioned on a portion of an insulated cover that surrounds the conductive wire. A conductive wire assembly and contact terminal are further described in U.S. patent application Ser. No. 14/597,461, filed Jan. 15, 2015, entitled "Systems and Methods for Forming a Conductive Wire Assembly," which claims priority to U.S. Provisional Application No. 62/061,978, filed Oct. 13, 2014, both of which are hereby incorporated by reference in their entireties.

Because the height $h_1$ exceeds the height $h_2$, the conductor crimp member 206 forms a deeper crimp than the sealing crimp member 208. The deeper crimp formed by the conductor crimp member 206 may be used to securely crimp metal portions of the terminal housing of the contact terminal into metal wire portions of the conductive wire, while the shallower crimp formed by the sealing crimp member 208 may be used to securely crimp to a plastic insulated cover of a conductive wire, for example, in order to form a sealing interface. Alternatively, the crimp wheel 200 may include various other sized and shaped conductive crimp and sealing crimp members. Also, alternatively, the crimp wheel 200 may include only a conductive crimp member, and not a sealing crimp member, or vice versa.

Figure 4:
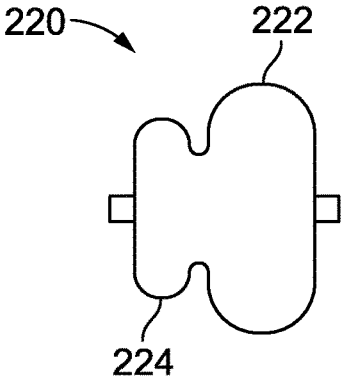
FIG. 4 illustrates a front view of a crimp wheel, according to an embodiment of the present disclosure.

FIG. 4 illustrates a front view of a crimp wheel 220, according to an embodiment of the present disclosure. The crimp wheel 220 may include a conductive crimp member 222 and a sealing crimp member 224. As shown, both the crimp members 222 and 224 may have a similar shape, but the sealing crimp member 224 may be shorter than the conductive crimp member 222. Alternatively, the crimp members 222 and 224 may have the same height.

Figure 5:
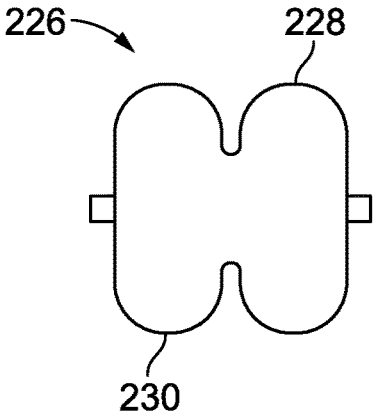
FIG. 5 illustrates a front view of a crimp wheel, according to an embodiment of the present disclosure.

FIG. 5 illustrates a front view of a crimp wheel 226, according to an embodiment of the present disclosure. The crimp wheel 226 may include a conductive crimp member 228 and a sealing crimp member 230. As shown, both the crimp members 228 and 230 may have a similar shape and the same height.

Figure 6:
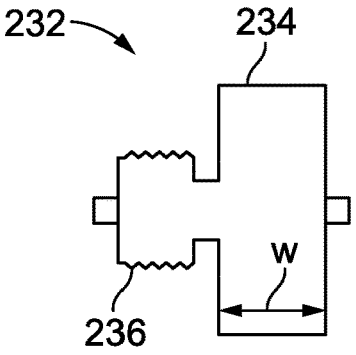
FIG. 6 illustrates a front view of a crimp wheel, according to an embodiment of the present disclosure.

FIG. 6 illustrates a front view of a crimp wheel 232, according to an embodiment of the present disclosure. The crimp wheel 232 may include a conductive crimp member 234 and a sealing crimp member 236. The conductive crimp member 234 may have a constant diameter through its width w. The sealing crimp member 236 may have one or more seal-indenting features, such as described above.

Figure 7:
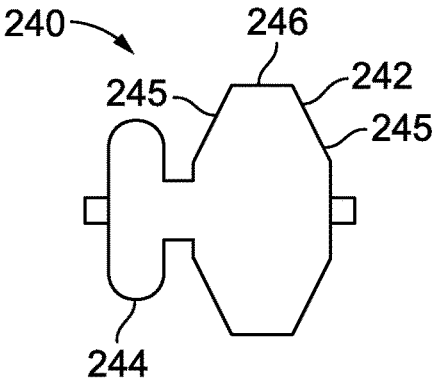
FIG. 7 illustrates a front view of a crimp wheel, according to an embodiment of the present disclosure.

FIG. 7 illustrates a front view of a crimp wheel 240, according to an embodiment of the present disclosure. The crimp wheel 240 may include a conductive crimp member 242 and a sealing crimp member 244. The conductive crimp member 242 may include recessed sides 245 that angle downwardly from a central rim 246. The sealing crimp member 244 may be sized and shaped as any of the embodiments described above, or may be sized and shaped similar to the conductive crimp member 242.

Referring to FIGS. 3-7, the crimp wheel may have one or more conductive crimp members and one or more sealing crimp members. Each of the crimp members may be various shapes and sizes. FIGS. 3-7 illustrates examples of crimp wheels, but it is to be understood that the crimp wheels may have various other shapes and sizes other than shown.

Figure 8:
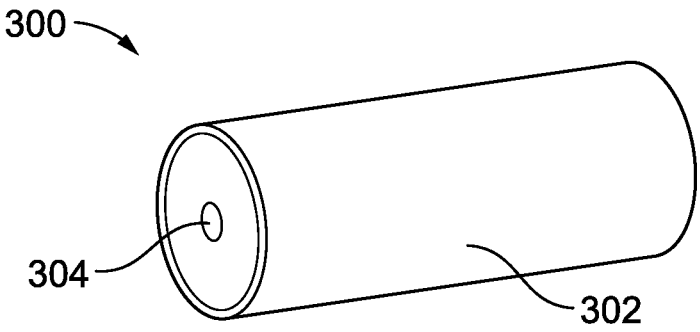
FIG. 8 illustrates a perspective view of a roller, according to an embodiment of the present disclosure.

FIG. 8 illustrates a perspective view of a roller 300, according to an embodiment of the present disclosure. The roller 300 is an example of the roller 148 or 150, shown in FIGS. 1 and 2. The roller 300 may include a smooth cylindrical body 302 having a central axle passage 304 formed therethrough. An axle is positioned through the axle passage 304, and the roller 300 is configured to rotate about the axle.

Figure 9:
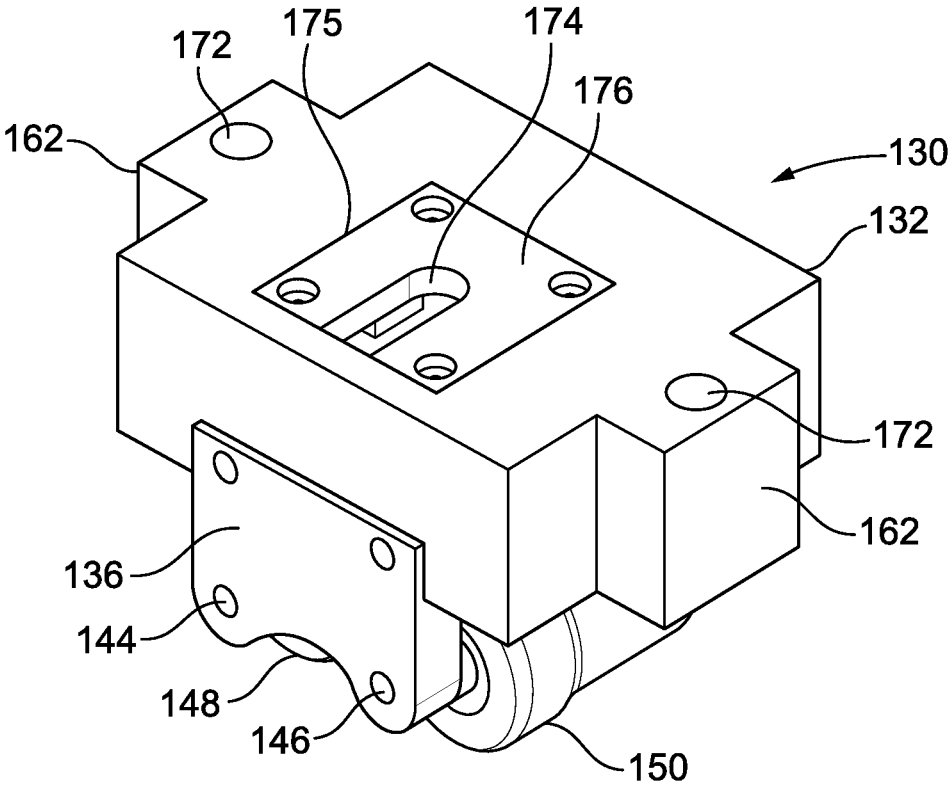
FIG. 9 illustrates a perspective top view of an adjustable mount, according to an embodiment of the present disclosure.

FIG. 9 illustrates a perspective top view of the adjustable mount 130, according to an embodiment of the present disclosure. As shown, cylinder channels 172 are formed through the lateral supports 162 and are configured to slidably retain the cylinders 160 supported by the bottom and upper frames 102 and 104, respectively (shown in FIGS. 1 and 2). A recessed area 174 is formed through an upper surface 175 and is covered by a retaining plate 176. A portion of an adjustment member, such as a knob, is securely retained with the recessed area 174. For example, the adjustment member may include a threaded shaft having a retaining structure, such as a ball, at a distal end. The retaining structure may be within the recessed area 174 underneath the retaining plate 176 to securely connect the adjustment member to the adjustable mount 130. Accordingly, as the adjustment member threadably engages portions of a threaded interface of the upper frame 104, the adjusting plate 130 is moved within the crimping chamber 170 (shown in FIGS. 1 and 2), as described above.

Figure 10:
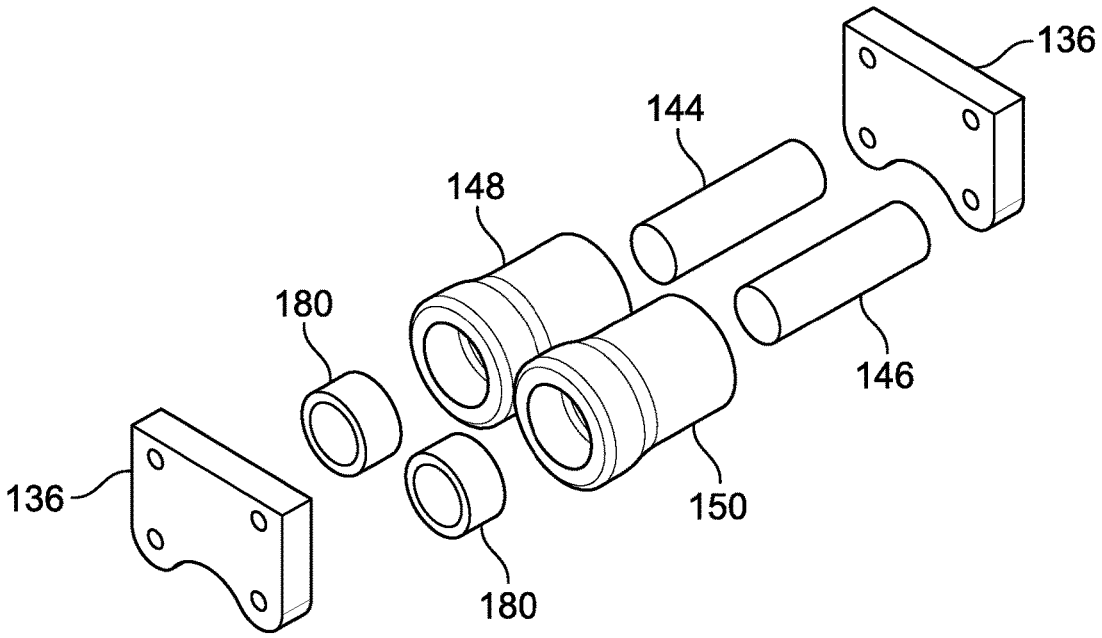
FIG. 10 illustrates a perspective exploded view of rollers between opposed brackets, according to an embodiment of the present disclosure.

FIG. 10 illustrates a perspective exploded view of the rollers 148 and 150 between opposed brackets 136, according to an embodiment of the present disclosure. As shown, cylindrical bearings 180 may be positioned within each roller 148 and 150, which may be rotatably secured to the brackets 136 by the axles 144 and 146, respectively. The bearings 180 may be needle roller bearings that are pressed into ends of the rollers 148 and 150. The axles 144 and 146, such as cylindrical shafts, extend through the respective rollers 148 and 150 and may be bolted to the brackets 136. Alternatively, the bearings 180 may not be used.

Figure 11:
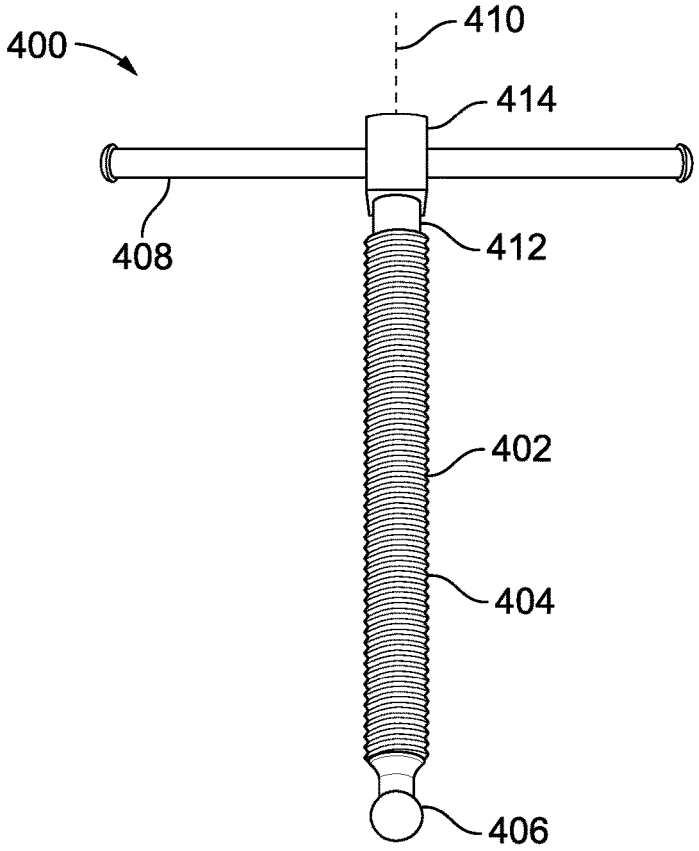
FIG. 11 illustrates a front view of an adjustment member, according to an embodiment of the present disclosure.

FIG. 11 illustrates a front view of an adjustment member 400, according to an embodiment of the present disclosure. The adjustment member 400 may include a threaded shaft 402 having a threaded outer surface 404. A retaining structure 406, such as a ball, extends from a distal end of the threaded shaft 402. A handle 408 that may be perpendicular to a longitudinal axis 410 of the threaded shaft 402 may connect to a proximal end 412 of the threaded shaft 402 through a connection joint 414.

Referring to FIGS. 1, 2, 9, and 10, the retaining structure 406 is trapped within the recessed area 174 of the adjuster retainer 128 by the retaining plate 176. As such, the adjustment member 400 is secured to the adjustable mount 130. Because the retaining structure 406 is a smooth sphere or ball, as the adjustment member 400 is rotated, the smooth interface between the retaining structure 406 and the adjustable mount 130 does not cause the adjustable mount to rotate along with the adjustment member 400. However, because the retaining structure 406 is trapped within the recessed area 174 by the retaining plate 176, as the adjustment member 400 moves up and down in the direction of arrows 134 relative to the upper frame 104, the adjustable mount 130 moves up or down in response thereto.

The threaded shaft 402 is threadably secured within a threaded channel formed through the adjuster retainer 128. Thus, the threaded shaft 402 is configured to threadably move through the threaded channel. As the threaded shaft 402 is rotated in relation to the adjuster retainer 128, the adjustable mount 130 moves up and down in the directions of arrow 134 in response thereto.

Figure 12:
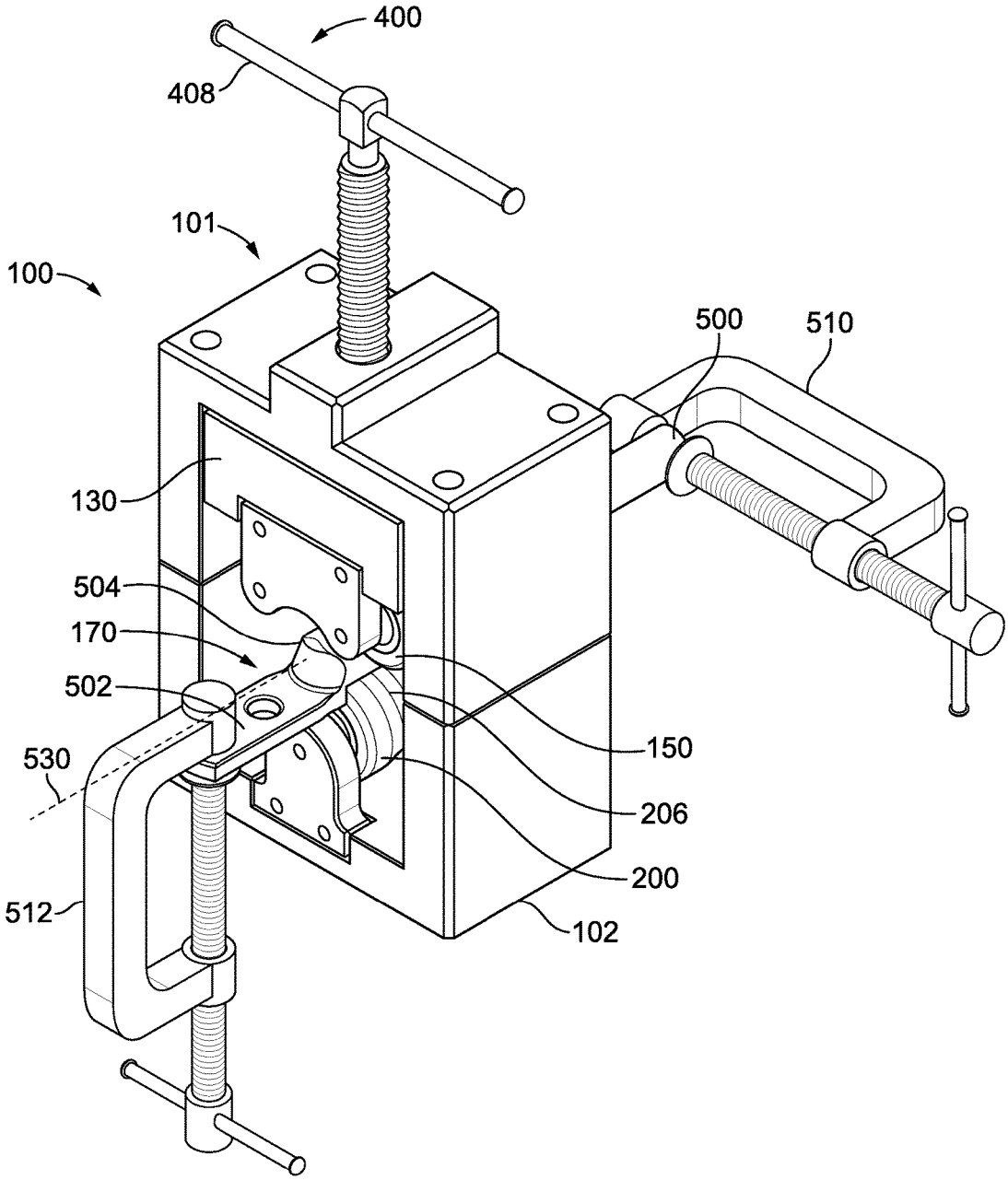
FIG. 12 illustrates a perspective top view of an insulated wire and contact terminal positioned within a crimping chamber of a rotary crimping tool assembly, according to an embodiment of the present disclosure.

FIG. 12 illustrates a perspective top view of an insulated wire 500 and contact terminal 502 positioned within the crimping chamber 170 of the rotary crimping tool assembly 100, according to an embodiment of the present disclosure. Initially, a conductive portion of the insulated wire 500 is positioned within a terminal housing of the contact terminal 502. The contact terminal 502 is then positioned within the crimping chamber 170 such that the contact terminal 502 is positioned between the conductive crimping member 206 and the rollers 148 and 150. Sealing portions of the insulated wire and/or the contact terminal may be positioned between the sealing crimping member 208 (shown in FIG. 3) and the rollers 148 and 150. After being positioned within the crimping chamber 170, the insulated wire 500 and the contact terminal 502 may be securely clamped in place, such as through vises 510 and 512. While vises 510 and 512 are shown, only one of the vises 510 or 512 may be used. After the insulated wire 500 and the contact terminal 502 are securely fixed in place, the handle 408 of the adjustment member 400 may be engaged to urge the adjustable mount 130 toward the bottom frame 102 so that the portions of the contact terminal 502 and the insulated wire 500 are compressively sandwiched between the rollers 148, 150, and the crimp wheel 200. The handle 408 may continue to be torqued to provide a desired amount of crimping force into the contact terminal 502 and the insulated wire 500. Once a desired amount of force is reached, the rotary crimping tool assembly 100 may be grasped and rotated about the insulated wire 500 and the contact terminal 502 in the direction of arc 520, shown in FIG. 1 (optionally, the rotation direction may be opposite to the direction of arc 520). The rotary crimping tool assembly 100 may be rotated one complete 360° revolution about a central axis 530 that is centered between the axles 118, 144, and 146. As the rotary crimping tool assembly 100 rotates about the central axis 530, one or more full crimps are radially and circumferentially formed between areas of the insulated wire 500 and the contact terminal 502.

The rotary crimping tool assembly 100 may be rotated more than one complete revolution (that is, multiple complete revolutions) about the central axis 530 to form a full and/or uniform radial crimp. Alternatively, the rotary crimping tool assembly 100 may be rotated less than a full 360° about the central axis 530 to form a crimp. After the conductive wire assembly is securely crimped, the handle 408 may be grasped and rotated to move the adjustable mount 130 away from the conductive wire assembly and contact terminal.

Figure 13:
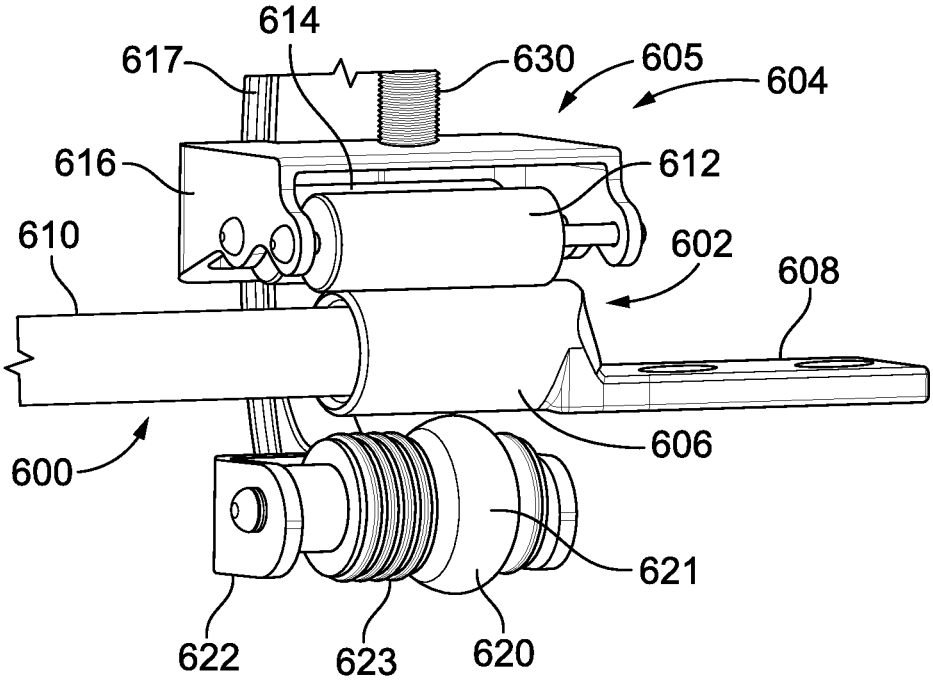
FIG. 13 illustrates a perspective front view of a conductive wire assembly positioned within a crimping chamber of a rotary crimping tool assembly, according to an embodiment of the present disclosure.

FIG. 13 illustrates a perspective front view of a conductive wire assembly 600 positioned within a crimping chamber 602 of a rotary crimping tool assembly 604 having a tool housing 605, according to an embodiment of the present disclosure. As shown, a terminal housing 606 of a contact terminal 608 retains a portion of an insulated wire 610. The terminal housing 606 is positioned underneath and between rollers 612 and 614 of an adjustable mount 616 of the rotary crimping tool assembly 604. The adjustable mount 616 is threadably secured to a main support frame 617 of the rotary crimping tool assembly 604. Further, a crimp wheel 620 rotatably secured to a bracket 622 connected to the main support frame 617 is positioned below the terminal housing 606. In order to form one or more crimps between the contact terminal 608 and the insulated wire 610, and adjustment member 630 is engaged to move the adjustable mount 616 toward the crimp wheel 620 so that the terminal housing 606 is compressively trapped between the crimp wheel 620 and the rollers 612 and 614.

Figure 14:
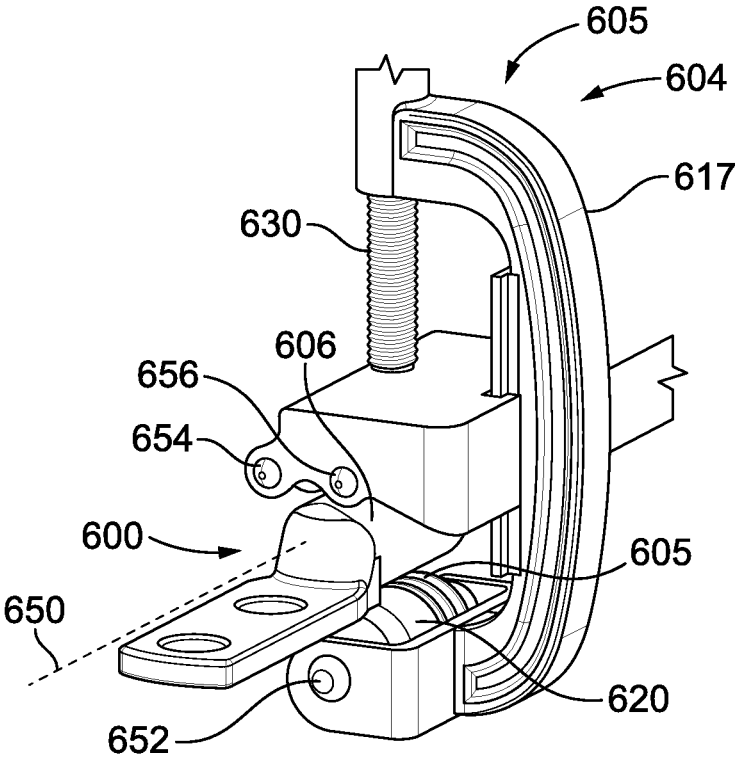
FIG. 14 illustrates a perspective rear view of a conductive wire assembly positioned within a crimping chamber of a rotary crimping tool assembly, according to an embodiment of the present disclosure.

FIG. 14 illustrates a perspective rear view of the conductive wire assembly 600 positioned within the crimping chamber 602 of the rotary crimping tool assembly 604, according to an embodiment of the present disclosure. The adjustment member 630 is engaged so that the crimp wheel 620 exerts a desired force into the terminal housing 606, thereby forming one or more initial crimps at an initial position. In order to fully form the one or more crimps, the rotary crimping tool assembly 604 is then rotated about a central axis 650 that is centered between the axles 652, 654, and 656.

Figure 15:
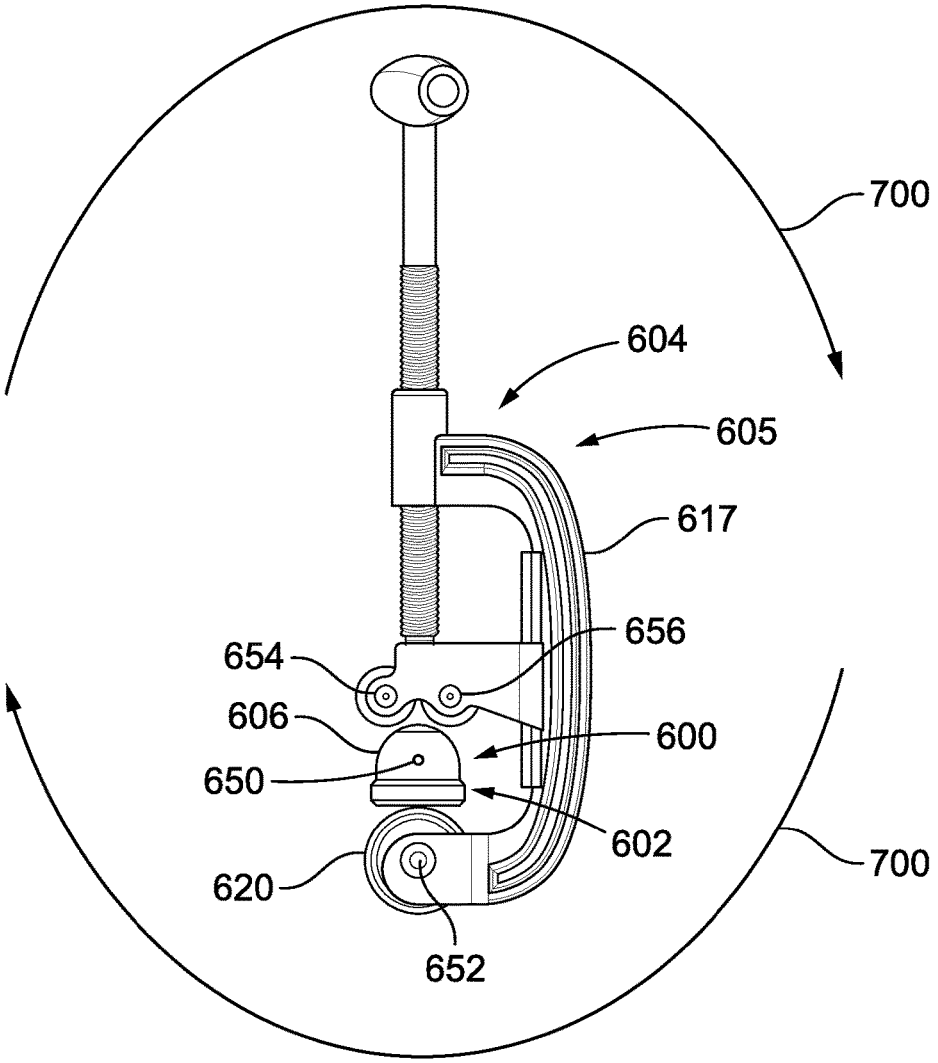
FIG. 15 illustrates a lateral view of a conductive wire assembly positioned within a crimping chamber of a rotary crimping tool assembly, according to an embodiment of the present disclosure.

FIG. 15 illustrates a lateral view of the conductive wire assembly 600 positioned within the crimping chamber 602 of the rotary crimping tool assembly 604, according to an embodiment of the present disclosure. In order to fully form the one or more crimps in the terminal housing 606, the rotary crimping tool assembly 604 is rotated about the central axis 650 in the direction of arcs 700. The rotary crimping tool assembly 604 may be rotated a complete 360° about the central axis 650 to form one or more full, uniform crimps in the terminal housing 606.

Figure 16:
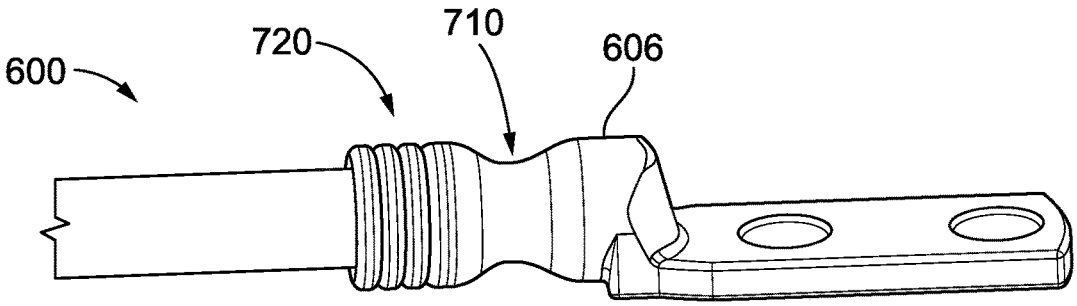
FIG. 16 illustrates a perspective view of a conductive wire assembly having a finished, uniform conductive crimp and a finished, uniform sealing crimp, according to an embodiment of the present disclosure.

FIG. 16 illustrates a perspective view of the conductive wire assembly 600 having a finished, uniform conductive crimp 710 and a finished, uniform sealing crimp 720, according to an embodiment of the present disclosure. Referring to FIGS. 13 and 16, the uniform conductive crimp 710 is formed in the terminal housing 606 by a conductive crimp member 621 of the crimp wheel 620, while the uniform sealing crimp 720 is formed in the terminal housing 606 by a sealing crimp member 623 of the crimp wheel 620.

Referring to FIGS. 1-16, one or more of the crimp wheels and/or the rollers may be operatively connected to actuators, such as motors, that may automatically rotate the crimp wheels and/or the rollers. In this manner, the rotary crimping tool assemblies may be motorized and automatically rotated about a structure. In at least one embodiment, the rotary crimping tool assembly may be battery powered, or may be connected to a source of power (such as a wall outlet), in order to provide power to the actuators.

The rotary crimping tool assemblies described above may be handheld devices that are configured to be quickly and easily transported between locations. For example, the length of a rotary crimping tool assembly may be between 100-200 mm, while the width may be between 50-100 mm, and the height may be between 100-200 mm. Alternatively, the dimensions of the rotary crimping tool assemblies may be greater or lesser than listed.

Figure 17:
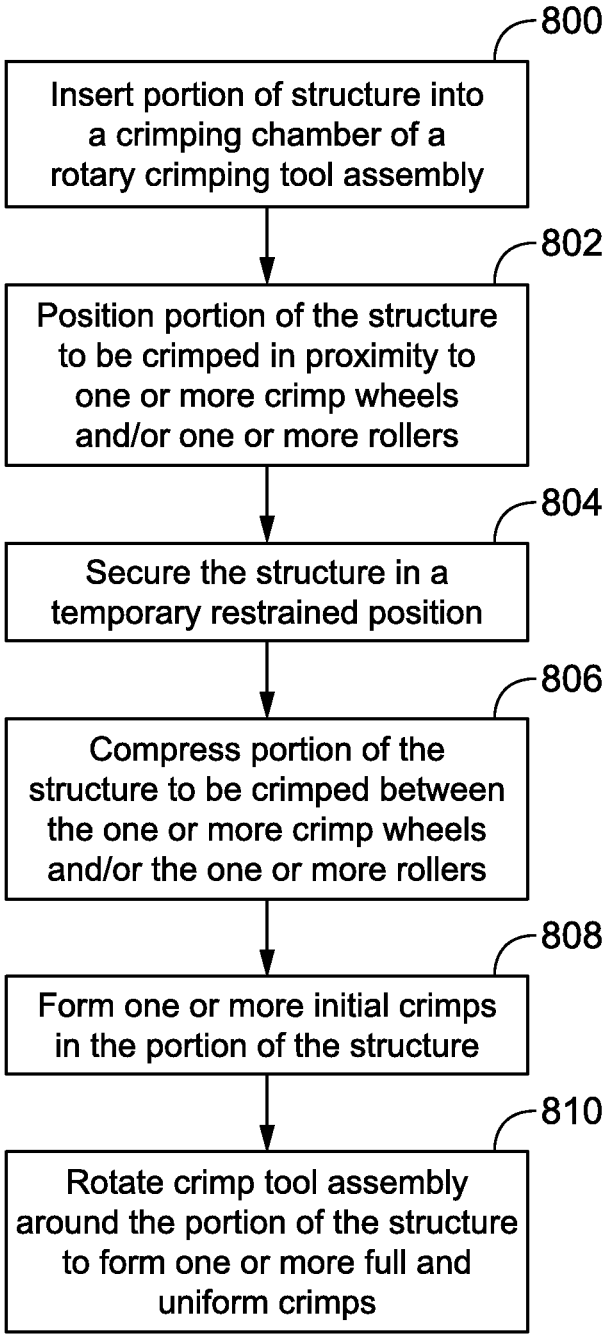
FIG. 17 illustrates a flow chart of a method of forming one or more crimps in a structure, according to an embodiment of the present disclosure.

FIG. 17 illustrates a flow chart of a method of forming one or more crimps in a structure, according to an embodiment of the present disclosure. At 800, a portion of a structure to be crimped is inserted into a crimping chamber of a rotary crimping tool assembly. For example, the structure may be a conductive wire assembly, in which a terminal housing of a contact terminal is to be crimped to an insulated wire.

At 802, the portion of the structure to be crimped is then positioned in proximity to one or more crimp wheels and/or one or more rollers. For example, the rotary crimping tool assembly may include a single crimp wheel below two rollers, and the portion of the structure is positioned therebetween. In another embodiment, the rotary crimping tool assembly may include a first crimp wheel positioned directly below a second crimp wheel (and no rollers). In other embodiment, the rotary crimping tool assembly may include a first crimp wheel positioned below second and third crimped wheels, in which rotation axes of the second and third crimp wheels reside in a common plane that is parallel to a base of the rotary crimping tool assembly.

At 804, the structure to be crimped is secured in a temporary restrained position. For example, one or more vises, clamps, or the like may be used to temporarily restrain the structure in a fixed position.

At 806, the portion of the structure to be crimped is compressed between the one or more crimp wheels and the one or more rollers. For example, an adjustment member may be engaged to compress the portion of the structure between the one or more crimp wheels and the one or more rollers.

At 808, one or more initial crimps may be formed in the portion of the structure. For example, the adjustment member may be engaged to exert a desired force into the portion of the structure that forms the initial crimp.

At 810, the crimp tool assembly is then rotated around the portion of the structure to form one or more full and uniform crimps therein. For example, the crimp tool assembly may be rotated a full 360° about the portion of the structure to form the one or more full and uniform crimps. It is to be understood that a full and uniform crimp may be formed through one or more full 360° rotations. For example, multiple full rotations may be used to form a full and uniform crimp.

As described above, embodiments of the present disclosure provide a rotary crimping tool assembly that may be used to crimp components of a structure together, such as a contact terminal and an insulated wire of a conductive wire assembly. Embodiments of the present disclosure may also be used to splice components together. Also, the components may include grounding jumpers, and various other components other than contact terminals. The rotary crimping tool assembly may be used to crimp conductive portions of an insulated wire to a contact terminal, and crimp sealing members of the insulated wire and the contact terminal together. The rotary crimping tool assembly may be sized and shaped to be operated by hand.

Embodiments of the present disclosure provide systems and methods for crimping components together in a rotary manner. For example, the systems and methods may crimp components together through a single revolution or multiple revolutions. Each crimp wheel may be various sizes and shapes. For example, a portion of the crimp wheel may include a conductor crimp member and a sealing crimp member. The conductor crimp member may have a first height that exceeds a second height of the sealing crimp member. As such, the conductor crimp member may form a deeper crimp, while the sealing crimp member may provide one or more peaks that are shallower than the crimp formed by the conductor crimp member.

While various spatial terms, such as upper, bottom, lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f), unless and until such claim limitations expressly use the phrase "means for" followed by a statement of function void of further structure.

What is claimed is:

1. A rotary crimping tool assembly configured to crimp a portion of a structure, the rotary crimping tool assembly comprising:

a tool housing defining a crimping chamber; and one or more crimp wheels within the crimping chamber, wherein the crimping chamber is configured to receive the portion of the structure in proximity to the one or more crimp wheels, and wherein the one or more crimp wheels are configured to be pressed into and rotated relative to the portion of the structure to form one or more crimps in the portion of the structure;

wherein each of the one or more crimp wheels comprises a conductor crimp member and a sealing crimp member, wherein the conductor crimp member has a different shape than the sealing crimp member, wherein the conductor crimp member includes a smooth, arcuate outer surface having a central equator from which lateral portions recede, wherein the sealing crimp member has a plurality of seal-indenting features, wherein the conductor crimp member has a first height and the sealing crimp member has a second height, wherein the first height exceeds the second height, the conductor crimp member is configured to form a first crimp at a first depth into the portion of structure, and the sealing crimp member is configured to form a second crimp at a second depth into the portion of structure, and wherein the first depth is deeper than the second depth.

2. The rotary crimping tool assembly of claim 1, wherein the tool housing comprises a first frame secured to a second frame.

3. The rotary crimping tool assembly of claim 2, further comprising:

an adjustable mount adjustably secured to one or both of the first and second frames; and one or more rollers rotatably secured to the adjustable mount, wherein the one or more rollers comprise a smooth cylindrical body, wherein the one or more crimp wheels are secured to one of the first and second frames, wherein the crimping chamber is configured to receive the portion of the structure between the one or more crimp wheels and the one or more rollers, wherein the adjustable mount is configured to be adjusted to compress the portion of the structure between the one or more crimp wheels and the one or more rollers, and wherein the one or more crimp wheels and the one or more rollers are configured to be rotated about the portion of the structure to form the one or more crimps.

4. The rotary crimping tool assembly of claim 3, wherein the one or more rollers comprises first and second rollers rotatably secured to first and second roller axles that are secured to the adjustable mount, wherein the one or more crimp wheels are rotatably secured to a crimp axle that is rotatably secured to one of the first and second frames, wherein the crimp axle resides within a central plane, and wherein the first and second roller axles reside within first and second roller planes, respectively, that are parallel with and offset from the central plane.

5. The rotary crimping tool assembly of claim 3, further comprising an adjustment member operatively connected to the adjustable mount, wherein the adjustment member is configured to adjust the adjustable mount in relation to the crimping chamber.

6. The rotary crimping tool assembly of claim 5, wherein the adjustment member comprises a threaded shaft connected to a handle, wherein the threaded shaft is threadably secured within a portion of one of the first or second frames.

7. The rotary crimping tool assembly of claim 6, wherein the adjustment member further comprises a retaining structure extending from a distal end of the threaded shaft, wherein the retaining structure is secured within a recessed area of the adjustable mount.

8. A method of crimping a structure, the method comprising:

positioning a portion of the structure to be crimped into a crimping chamber of a rotary crimping tool assembly;

pressing one or more crimp wheels into the portion of the structure to be crimped, wherein the pressing comprises forming one or more initial crimps into the portion of the structure; and rotating the one or more crimp wheels relative to the portion of the structure to form one or more full crimps in the portion of the structure, wherein the one or more crimps are configured to secure the first portion of the structure to a second portion of the structure;

wherein each of the one or more crimp wheels comprises a conductor crimp member and a sealing crimp member, wherein the conductor crimp member has a different shape than the sealing crimp member, wherein the conductor crimp member includes a smooth, arcuate outer surface having a central equator from which lateral portions recede, wherein the sealing crimp member has a plurality of seal-indenting features, wherein the conductor crimp member has a first height and the sealing crimp member has a second height, wherein the first height exceeds the second height, the conductor crimp member is configured to form a first crimp at a first depth into the portion of structure, and the sealing crimp member is configured to form a second crimp at a second depth into the portion of structure, and wherein the first depth is deeper than the second depth.

9. The method of claim 8, wherein the positioning comprises positioning the portion of the structure between the one or more crimp wheels and one or more rollers, and wherein the compressing comprises pressing the portion of the structure between the one or more crimp wheels and the one or more rollers, and wherein the rotating comprises rotating the one or more crimp wheels and the one or more rollers about the portion of the structure to form the one or more full crimps.

10. The method of claim 8, wherein the pressing comprises engaging an adjustment member to compress the one or more crimp wheels into the portion of the structure to be crimped.

11. The method of claim 8, further comprising temporarily restraining the portion of the structure from movement.

12. The method of claim 8, wherein the forming of the one or more initial crimps comprises forming multiple initial crimps into the portion of the structure with a single crimp wheel, and wherein the rotating comprises forming multiple full crimps in the portion of the structure with the single crimp wheel.

13. The method of claim 8, wherein the forming of the one or more initial crimps comprises forming initial first and second crimps at first and second depth, respectively, into the portion of structure, wherein the first depth is deeper than the second depth.

14. A rotary crimping tool assembly configured to crimp a terminal housing of a contact terminal into an insulated wire, wherein a conductive portion of the insulated wire is within the terminal housing, the rotary crimping tool assembly comprising:

a tool housing defining a crimping chamber;

an adjustable mount configured to be moved within the crimping chamber; and one or more crimp wheels within the crimping chamber, wherein the crimping chamber is configured to receive the terminal housing in proximity to the one or more crimp wheels, and wherein the adjustable mount is configured to urge the contact terminal into the one or more crimp wheels, and wherein the tool housing is configured relative to the terminal housing to form one or more crimps in the terminal housing;

wherein each of the one or more crimp wheels comprises a conductor crimp member and a sealing crimp member, wherein the conductor crimp member has a different shape than the sealing crimp member, wherein the conductor crimp member includes a smooth, arcuate outer surface having a central equator from which lateral portions recede, wherein the sealing crimp member has a plurality of seal-indenting features, wherein the conductor crimp member has a first height and the sealing crimp member has a second height, wherein the first height exceeds the second height, the conductor crimp member is configured to form a first crimp at a first depth into the terminal housing, and the sealing crimp member is configured to form a second crimp at a second depth into the terminal housing, and wherein the first depth is deeper than the second depth.

15. The rotary crimping tool assembly of claim 14, wherein the tool housing comprises a first frame secured to a second frame, wherein the adjustable mount is adjustably secured to one or both of the first and second frames, and wherein the rotary crimping tool assembly further comprises:

one or more rollers rotatably secured to the adjustable mount, wherein the one or more rollers comprises a smooth cylindrical body, wherein one or more crimp wheels are secured to one of the first and second frames, wherein the crimping chamber is configured to receive the terminal housing between the one or more crimp wheels and the one or more rollers, wherein the adjustable mount is configured to be adjusted to compress the terminal housing between the one or more crimp wheels and the one or more rollers, and wherein the one or more crimp wheels and the one or more rollers are configured to be rotated about the terminal housing to form the one or more crimps.

16. The rotary crimping tool assembly of claim 15, wherein the one or more rollers comprises first and second rollers rotatably secured to first and second roller axles that are secured to the adjustable mount, wherein the one or more crimp wheels are rotatably secured to a crimp axle that is rotatably secured to one of the first and second frames, wherein the crimp axle resides within a central plane, and wherein the first and second roller axles reside within first and second roller planes, respectively, that are parallel with and offset from the central plane.

17. The rotary crimping tool assembly of claim 15, further comprising an adjustment member operatively connected to the adjustable mount, wherein the adjustment member comprises a threaded shaft connected to a handle, and a retaining structure extending from a distal end of the threaded shaft, wherein the retaining structure is secured within a recessed area of the adjustable mount, wherein the threaded shaft is threadably secured within a portion of one of the first or second frames, and wherein the adjustment member is configured to adjust the adjustable mount in relation to the crimping chamber.

* * * * *